United States Patent [19]

Hasebe

[11] Patent Number: 4,608,660

[45] Date of Patent: Aug. 26, 1986

[54] DATA PROCESSING SYSTEM WITH CONDITION DATA SETTING FUNCTION

[75] Inventor: Kouki Hasebe, Tokyo, Japan

[73] Assignee: Tokyo Shibaura Denki Kabushiki Kaisha, Kawasaki, Japan

[21] Appl. No.: 573,715

[22] Filed: Jan. 25, 1984

[30] Foreign Application Priority Data

Jan. 28, 1983 [JP] Japan ..... 58-12528

[51] Int. Cl.[4] ..... G05F 7/50

[52] U.S. Cl. ..... 364/768

[58] Field of Search ..... 364/700, 715, 900 MS File, 364/736, 768, 200 MS file; 340/727, 736, 739, 740, 741

[56] References Cited

U.S. PATENT DOCUMENTS

| | | | |
|---|---|---|---|
| 4,041,461 | 8/1977 | Kratz et al. | 364/736 |
| 4,202,035 | 5/1980 | Lane | 364/200 |
| 4,272,808 | 6/1981 | Hartwig | 340/739 |
| 4,323,981 | 4/1982 | Nakamura | 364/200 |

*Primary Examiner*—James D. Thomas
*Assistant Examiner*—Dale M. Shaw
*Attorney, Agent, or Firm*—Cushman, Darby & Cushman

[57] ABSTRACT

A data processing system with a condition data setting function is provided. In the system, a microprogram memory designed stores a plurality of specific subtraction micro-instructions for obtaining condition data consisting of a combination of bits respectively representing the sign of the results of each of a plurality of substraction operations. A micro-instruction read out from said microprogram memory is loaded into a micro-instruction register. An arithmetic and logic section performs an arithmetic operation, in accordance with the specific subtraction micro-instructions loaded in said micro-instruction register, and outputs status data including a carry flag and a sign flag. A multiplexer selects the carry flag or sign flag, in accordance with the first specific bit of the specific subtraction micro-instruction loaded in said micro-instruction register. The flag thus selected is input to a serial-to-parallel shift register, as one of the bits of said condition data, under control of the second specific bit of the specific subtraction micro-instruction. The condition data is a direction discrimination code used in a Bresenham DDA and is used as an index for determining which processing operation is to be performed next.

8 Claims, 6 Drawing Figures

DATA PROCESSING SYSTEM WITH CONDITION DATA SETTING FUNCTION

BACKGROUND OF THE INVENTION

The present invention relates to a data processing system with a condition data setting function, which system determines the processing content of an operation, in accordance with condition data consisting of a combination of bits respectively representing the sign of a difference result obtained in each of a plurality of subtraction operations.

A graphic display apparatus having a monitor of a raster scan type is one such data processing system. In such a graphic display apparatus, a Bresenham DDA (Digital Differential Analyzer) is generally used to generate a line. In a Bresenham DDA, coordinates (line coordinates) of each lattice point (display dot) approximating a line (line segment) connecting a start point $P_0(x_0,y_0)$ and an end point $P_1(x_1,y_1)$ are generated in the following manner. According to the Bresenham DDA, the coordinate on the long axis (x or y-axis) is normally incremented or decremented by one (one dot or lattice point). Upon such an increase or decrease in the coordinate on the long axis, the absolute value of the slope of a line, with respect to the long axis, is added to a discrimination equation D. In contrast to this, the coordinate along the short axis (y or x-axis) is only incremented or decremented by one when $D>\frac{1}{2}$. Note that the initial value of the discrimination equation D is 0. When $D\geqq 1$, the value of the equation D is decremented by one, and a difference $(D-1)$ is used as the updated equation D.

The Bresenham DDA has eight line (line coordinate) generating functions. Which one of the eight line generating functions is to be used is determined in accordance with a combination of signs (positive (including zero) and negative values) of $y_1-y_0(=\Delta y)$, $x_1-x_0(=\Delta x)$, and $|x_1-x_0|-|y_1-y_0|(=S)$ associated with a line connecting a start point $P_0(x_0,y_0)$ and an end point $P_1(x_1,y_1)$. The total number of sign combinations of the is eight. Lines adopted in the Bresenham DDA are thus classified into eight types I to VIII. FIG. 1 shows examples of lines of these eight types I to VIII. Whether $\Delta y$, $\Delta x$ and S of each type are positive or negative is shown in the following table 1.

TABLE 1

| Type | $\Delta y$ | $\Delta x$ | S |
|---|---|---|---|
| I | Positive | Positive | Positive |
| II | Positive | Positive | Negative |
| III | Positive | Negative | Negative |
| IV | Positive | Negative | Positive |
| V | Negative | Negative | Positive |
| VI | Negative | Negative | Negative |
| VII | Negative | Positive | Negative |
| VIII | Negative | Positive | Positive |

In the case of a line having a positive (including zero) value of S, the x-axis is assigned as the long axis, and the y-axis is assigned as the short axis. In the case of a line having a negative value of S, the y-axis is assigned as the long axis, and the x-axis is assigned as the short axis. With this assignment of long and short axes, the slope of a line with respect to the long axis can be rendered to fall below 45° in any line of the eight types I to VIII. As is well known, the slope of a line with respect to the long axis falling below 45° is the fundamental condition for generating a line in a Bresenham DDA.

In a Bresenham DDA, whether the x-coordinate is to be incremented or decremented by one is determined by the sign of $\Delta x$. Whether the y-coordinate is to be incremented or decremented by one is determined by the sign of $\Delta y$. This amounts to saying that in a Bresenham DDA the generating directions (positive or negative direction) of the x and y-coordinates are determined by signs of $\Delta x$ and $\Delta y$, respectively.

In a graphic display apparatus adopting a Bresenham DDA, logic bits C2, C1 and C0 are set, which respectively indicate the positive (including zero) or negative value of S, $\Delta x$ and $\Delta y$. The 3-bit data consisting of bits C2, C1 and C0 indicates to which one of the eight types I to VIII the line belongs. The 3-bit data are called direction discrimination code. Bit C2 represents the fact that C2="0" and, for example, that $S\geqq 0$, i.e., that the x-axis is assigned as the long axis. Bit C2 also represents the fact that C2="1" and $S<0$, i.e., the y-axis is assigned as the long axis. Bit C1 represents the fact that C1="0" and, for example, that $\Delta x\geqq 0$, i.e., that the generating direction of the x-coordinate is positive. Bit C1 also represents the fact that C1="1" and $\Delta x<0$, i.e., that the generating direction of the x-coordinate is negative. Bit C0 represents the fact that C0 ="0" and, for example, that $\Delta y\geqq 0$, i.e., that the generating direction of the y-coordinate is positive. Bit C0 also represents the fact that C0="1" and $\Delta y<0$, i.e., that the generating direction of the y-coordinate is negative. These relationships are shown in Table 2, below.

TABLE 2

| Type | Long Axis | Short Axis | X-coordinate Generating Direction | Y-coordinate Generating Direction | Direction Discrimination Code C2 | C1 | C0 |
|---|---|---|---|---|---|---|---|
| I | X-axis | Y-axis | Positive | Positive | 0 | 0 | 0 |
| II | Y-axis | X-axis | Positive | Positive | 1 | 0 | 0 |
| III | Y-axis | X-axis | Negative | Positive | 1 | 1 | 0 |
| IV | X-axis | Y-axis | Negative | Positive | 0 | 1 | 0 |
| V | X-axis | Y-axis | Negative | Negative | 0 | 1 | 1 |
| VI | Y-axis | X-axis | Negative | Negative | 1 | 1 | 1 |
| VII | Y-axis | X-axis | Positive | Negative | 1 | 0 | 1 |
| VIII | X-axis | Y-axis | Positive | Negative | 0 | 0 | 1 |

C2 = 0: long axis = x-axis
C2 = 1: long axis = y-axis
C1 = 0: positive x-coordinate generating direction
C1 = 1: negative x-coordinate generating direction
C0 = 0: positive y-coordinate generating direction
C0 = 1: negative y-coordinate generating direction In a Bresenham DDA, bits C2, C1 and C0 form a direction discrimination code. One of eight types of line generating functions is selected in accordance with this code. The processing content for generating a line is also determined in accordance with the direction discrimination code. Accordingly, the direction discrimination code is one type of condition data and generally obtained by software processing.

FIG. 2 is a flow chart of a conventional sequence for obtaining a direction discrimination code for a line connecting a start point $P_0(x_0,y_0)$ and an end point $P_1(x_1,y_1)$. As may be seen from FIG. 2, bits C2, C1 and C0 must be set to form a direction discrimination code. Conventionally, in order to determine a value Ci (where i=0, 1, 2), a number of steps are involved including a subtraction step ($\Delta y\leftarrow y_1-y_0$, $\Delta x\leftarrow x_1-x_0$, and $S\leftarrow|\Delta x|-|\Delta y|$), a conditional branch step for performing a conditional branch by determining the sign of the difference obtained in the subtraction step, and a Ci set step for setting the value Ci in accordance with the determination result obtained in the conditional branch step. For this reason, a conventional graphic display apparatus requires a long period of time for obtaining direction discrimination code and cannot generate lines at high speed. This problem is not limited to a graphic display apparatus, but is common to all data processing systems which determine the processing content in accordance with condition data comprising a combination of bits representing the sign of a difference obtained in each of a plurality of subtraction operations. To solve this problem, it is possible to use a hardware circuit for automatically setting condition data such as the direction discrimination code. However, since the addition of such a special circuit results in a higher cost of the overall system, it is impractical.

SUMMARY OF THE INVENTION

A primary object of the present invention is to provide a data processing system with a condition data setting function, which can set, at high speed and with the addition of only a small amount of hardware, condition data which determines the processing content and which comprises a combination of bits respectively representing the sign of a difference obtained in each of a plurality of subtraction operations, such as direction discrimination code used in a Bresenham DDA.

According to an aspect of the present invention, there is provided a data processing system with a condition data setting function, which system comprises: a microprogram memory for storing microprograms consisting of micro-instructions including a plruality of specific subtraction micro-instructions for obtaining condition data consisting of a combination of bits respectively representing the sign of the results of each of a plurality of subtraction operations; a micro-instruction register into which a micro-instruction read out from said microprogram memory is loaded; an arithmetic and logic section which performs an arithmetic operation, in accordance with the specific subraction micro-instruction loaded in said micro-instruction register, and which outputs status data including a carry flag and a sign flag; and a multiplexer for selecting one of said carry flag and sign flag, in accordance with the first specific bit of the specific subtraction micro-instruction loaded in said micro-instruction register; and serial-to-parallel converting means for receiving the output from said multiplexer, as one of the bits of said condition data, and shifting the data already stored, thereby holding the condition data which has been obtained from the specific subtraction micro-instructions.

BRIEF DESCRIPTION OF THE DRAWINGS

FIGS. 6*a*–6*f*, is a view showing changes in the content of a shift register shown in FIG. 3.

DETAILED DESCRIPTION OF THE PREFERRED EMBODIMENTS

Figure 1:
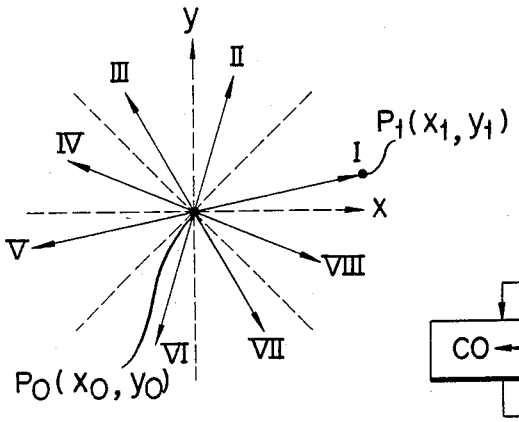
FIG. 1 PRIOR ART
FIG. 1 is a view showing an example of eight types of lines which are generated in a Bresenham DDA.
Figure 2:
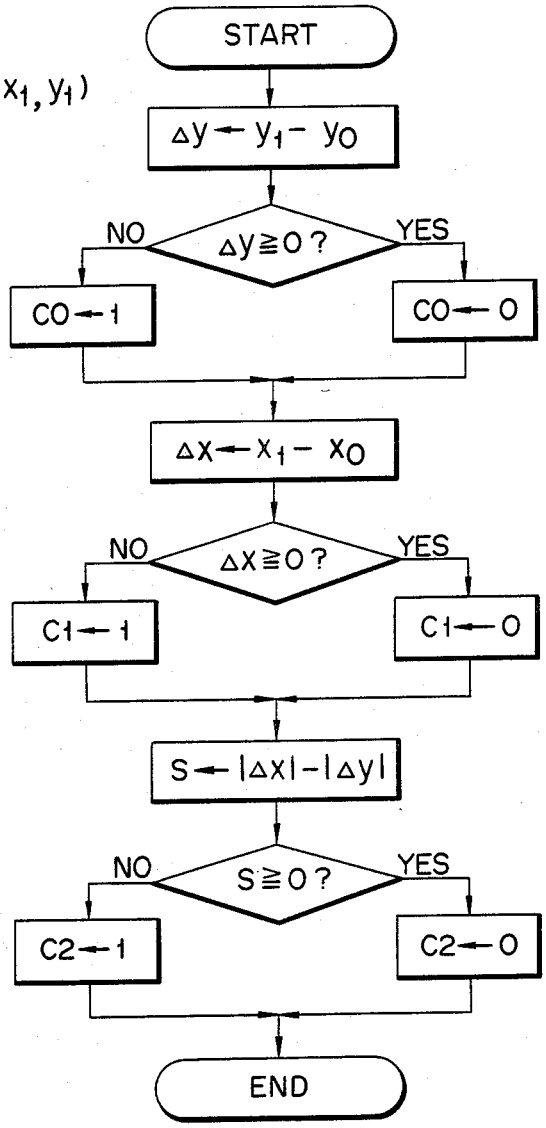
FIG. 2 PRIOR ART
FIG. 2 is a flow chart showing a conventional sequence for obtaining direction discrimination code which is adopted in a Bresenham DDA.
Figure 3:
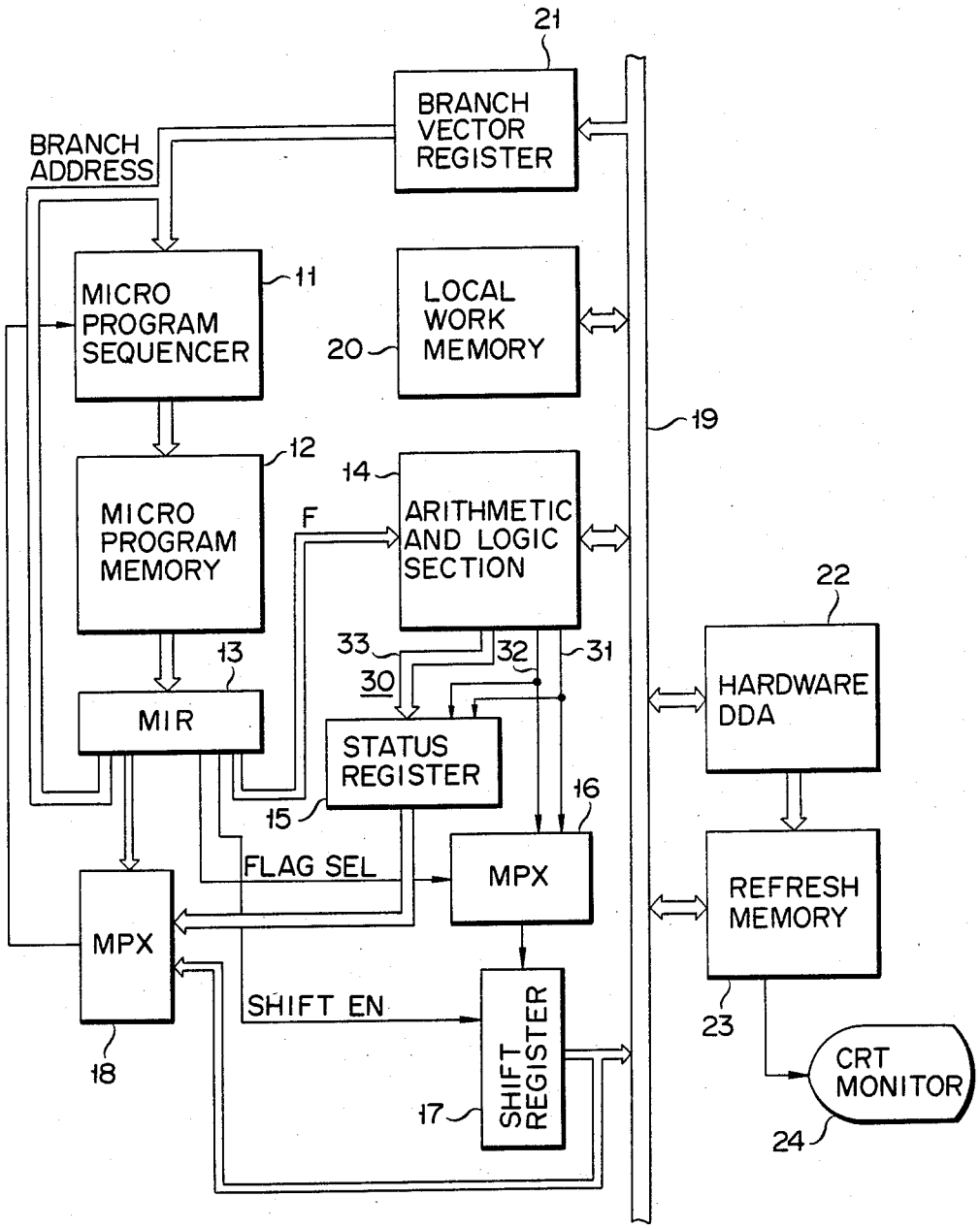
FIG. 3 is a block diagram of a graphic display apparatus according to an embodiment of the present invention.

FIG. 3 is a block diagram of a data processing system such as a graphic display apparatus adopting a Bresenham DDA, according to an embodiment of the present invention. Referring to FIG. 3, the microprogram sequencer 11 produces an address of a microprogram memory 12. The microprogram sequencer 11 has a known circuit configuration including a microprogram sequence control LSI such as an Am2909 available from Advanced Micro Device Inc. The microprogram memory 12 is connected to the microprogram sequencer 11 to receive the address therefrom. The microprogram memory 12 stores therein various microprograms including a microprogram for setting direction discrimination code, i.e., C2C1C0. A micro-instruction register (to be referred to as an MIR hereinafter) 13 is connected to the microprogram memory 12. A micro-instruction read out from the address of the microprogram memory 12 supplied from the microprogram sequencer 11 is loaded in the MIR 13. Micro-instructions used in this embodiment are roughly classified into operation micro-instructions, such as a subtraction micro-instruction; and branch micro-instructions, such as a conditional branch micro-instruction.

Figure 4:
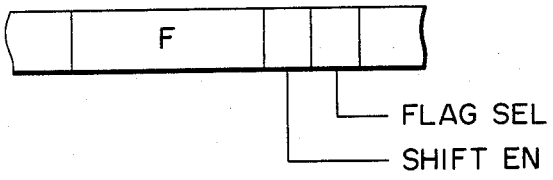
FIG. 4 shows the format of a main portion of an operation micro-instruction used in the graphic display apparatus shown in FIG. 3.

FIG. 4 shows the format of a main portion of an operation micro-instruction. The operation micro-instruction includes a function field F, a shift enable bit SHIFT EN (first specific bit), and a flag select bit FLAG SEL (second specific bit), as shown in FIG. 4. The function field F is for instructing an operation for an arithmetic and logic section 14 to be described later. The shift enable bit SHIFT EN is for instructing an input operation of a serial-to-parallel shift register 17 (to be described later) when the bit SHIFT EN is ON ("1"). In this embodiment, operation micro-instructions having shift enable bits SHIFT EN of logic level "1" are limited to specific subtraction micro-instructions (to be referred to as SUB & SHIFT micro-instructions, hereinafter). The flag select bit FLAG SEL is used as the control bit of a multiplexer 16 to be described later.

Referring again to FIG. 3, the arithmetic and logic section 14 is connected to the MIR 13. The arithmetic and logic section 14 has a circuit configuration including an ALU (arithmetic and logic unit), a register file, a Q register, a multiplexer (none of which are shown), and the like. The arithmetic and logic section 14 is obtained by connecting ICs Am2901 available from Advanced Micro Device Inc., in a cascaded form. Data of the function field F of a micro-instruction (operation micro-instruction) loaded into the MIR 13 is supplied to the arithmetic and logic section 14. The arithmetic and logic section 14 performs operations in accordance with the function field F of the micro-instruction and produces the results of the operations and the status data 30 of these results.

A status register 15 and a multiplexer (to be referred to as an MPX for brevity, hereinafter) 16 are connected to the arithmetic and logic section 14. The status data 30 from the arithmetic and logic section 14 is set in the status register 15. The status data 30 consists of a carry flag 31, a sign flag 32, and a flag group 33 excluding the carry flag 31 and the sign flag 32. The flag group 33 includes a zero flag and an overflow flag. The carry flag 31 and the sign flag 32 in the status data 30 are also supplied to the MPX 16. The MPX 16 is also connected to the MIR 13. The flag select bit FLAG SEL of the micro-instruction (operation micro-instruction) loaded in the MIR 13 is supplied to the MPX 16. The MPX 16 selects either the carry flag 31 or the sign flag 32, in accordance with the flag select bit FLAG SEL.

The 3-bit serial-to-parallel shift register (to be referred to as a shift register for brevity, hereinafter) 17 is connected to the MPX 16. The shift register 17 is also connected to the MIR 13. The selected output bit from the MPX 16 is supplied to the shift register 17 as one of the serial input bits. The shift enable bit SHIFT EN of the micro-instruction (operation micro-instruction) loaded into the MIR 13 is supplied to the shift register 17, as a control bit. The output of the shift register 17 is connected to a multiplexer 18 (to be referred to as MPX) and a bus 19. The outut data from the register 15 and MIR 13 are supplied to the MPX 18. The output data of the MIR 13 is a micro-instruction (branch micro-instruction). The MPX 18 selects one condition bit which is designated by the condition field data of the micro-instruction from either the status register 15 or shift register 17. The selected output bit from the MPX 18 is supplied to the microprogram sequencer 11.

The bus 19 is also connected to the arithmetic and logic section 14, a local work memory 20, a branch vector register 21, a hardware DDA 22, and a refresh memory 23. The local work memory 20 is used as a memory area for storing data which is to be processed in accordance with a microprogram. The branch vector register 21 is used as a branch address setting register when a program branch is performed, in accordance with data (branch address) generated by microprogram processing (an operation performed by the arithmetic and logic section 14). The set content of the branch vector register 21 is supplied to the microprogram sequencer 11.

The hardware DDA 22 generates line coordinate data in accordance with the direction discrimination code, i.e., C2C1C0, and necessary parameters. The hardware DDA 22 is, e.g., the DDA function section of a graphic display controller μPD 7220, which is available from NEC. Note that when a μPD 7220 is used, a decoder for decoding the direction discrimination code, i.e., C2C1C0 must be inserted at the input of the μPD 7720. The refresh memory 23 is connected to the hardware DDA 22. The refresh memory 23 stores the coordinate data which is generated by the hardware DDA 22 and graphic display data which is transferred from the local work memory 20 through the bus 19. A CRT monitor 24 is connected to the refresh memory 23. The storage content of the refresh memory 23 is displayed on the CRT monitor 24 under the control of a display controller (not shown). In the graphic display apparatus shown in FIG. 3, the main additional hardware is the MPX 16, the shift register 17 and the MPX 18.

Figure 5:
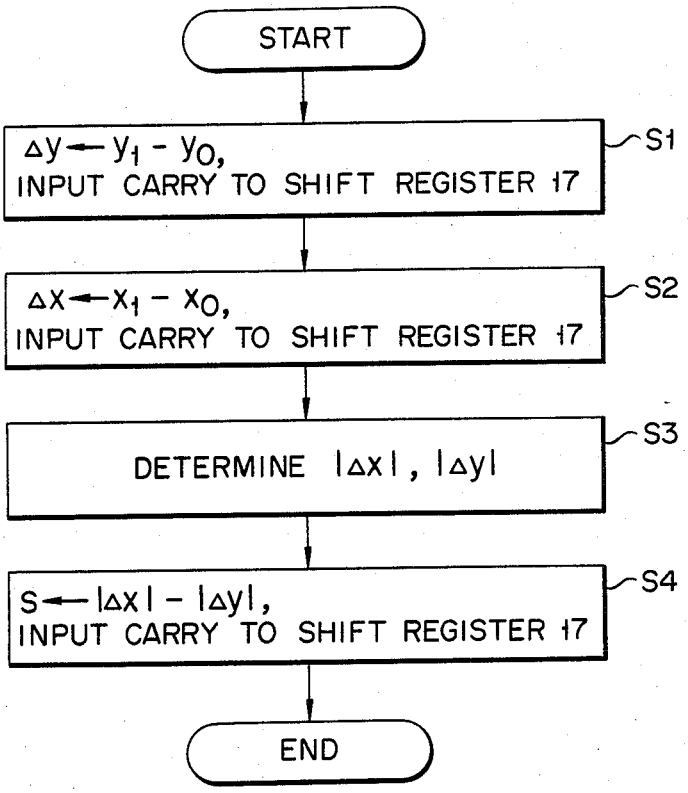
FIG. 5 is a flow chart of a microprogram for setting direction discrimination codes, which microprogram is to be used in the graphic display apparatus shown in FIG. 3.
Figure 6:
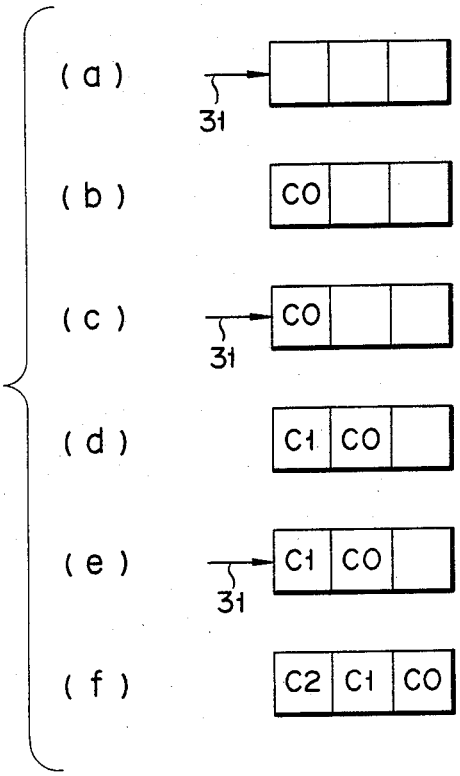
FIG. 6, comprising

The mode of operation of the first embodiment of the present invention, as described above, may be described as follows, with reference to FIGS. 5 and 6. FIG. 5 shows the flow chart of a microprogram for setting direction discrimination code, i.e., C2C1C0, for a line connecting a start point $P_0(x_0,y_0)$ and an end point $P_1(x_1,y_1)$; and FIG. 6 shows a change in the content of the shift register 17 shown in FIG. 3. In this embodiment, prior to the setting of the direction discrimination code, i.e., C2C1C0, processing is performed for storing the x and y-coordinates of the start and end points $P_0$, $P_1$, respectively, in the register file (not shown) of the arithmetic and logic section 14. After this processing has been performed, processing for setting the direction discrimination code, i.e., C2C1C0, is started, as shown in FIG. 5. In this embodiment, in order to obtain bit C0 of the direction discriminating code, a first SUB & SHIFT micro-instruction instructing $\Delta y \leftarrow y_1 - y_0$ is fetched from the microprogram memory 12. The first SUB & SHIFT micro-instruction is loaded in the MIR 13. The data of the function field F of the first SUB & SHIFT micro-instruction loaded in the MIR 13 is supplied to the arithmetic and logic section 14. The arithmetic and logic section 14 performs a subtraction $y_1 - y_0$ in accordance with the instruction of the function field F of the first SUB & SHIFT micro-instruction. The register (i.e., the register file of the arithmetic and logic section 14) storing $y_1$ and $y_0$ is designated by two source register fields in the first SUB & SHIFT micro-instruction.

When subtraction $y_1 - y_0$ is executed, the arithmetic and logic section 14 produces a subtraction result or difference $\Delta y$, and the corresponding status data 30. The difference $\Delta y$ obtained by the arithmetic and logic section 14 is stored in the register file in the arithmetic and logic section 14. The destination register of the difference $\Delta y$ is designated by a destination field in the first SUB & SHIFT micro-instruction. The status data 30 from the arithmetic and logic section 14 is supplied to the status register 15, being set therein. The carry flag 31 and the sign flag 32 in the status data 30 are also supplied to the MPX 16. The MPX 16 selects and outputs one of the carry flag 31 and the sign flag 32 in accordance with the flag select bit FLAG SEL of the first SUB & SHIFT micro-instruction loaded in the MIR 13. The flag select bit FLAG SEL designates selection of the carry flag 31 in the case where the processing data (y-coordinate in this case) has no sign. Alternatively, the flag select bit FLAG SEL is set to designate selection of the sign bit 32 in the case where the processing data has a sign. In this embodiment, the flag select bit FLAG SEL is set to designate selection of the carry flag 31. Thus, the MPX 16 selects the carry flag 31. The selected output bit from the MPX 16, i.e., the carry flag 31, is supplied to the shift register 17, as shown in FIG. 6(*a*). The carry flag 31 which serves as an input to the shift register 17 is set in the shift register 17 as bit C0 of the direction discrimination code, as shown in FIG. 6(*b*), in response to the shift enable bit SHIFT EN of logic level "1" in the first SUB & SHIFT micro-instruction loaded in the MIR 13, upon completion of the execution of the first SUB & SHIFT micro-instruction. These operations are carried out in step S1 (FIG. 5).

Similarly, a second SUB & SHIFT micro-instruction, instructing execution of the operation represented as $\Delta x = x_1 - x_0$ is executed (step S2 in FIG. 5). Thus, the difference $\Delta x$ $(=x_1 - x_0)$ is calculated by the arithmetic and logic section 14. The carry flag 31 in the status data 30 from the arithmetic and logic section 14 is supplied to the shift register 17, as shown in FIG. 6(*c*). The carry flag 31 is set in the shift register 17 as bit C1 of the direction discrimination code, as shown in FIG. 6(*d*), upon completion of the second SUB & SHIFT micro-instruction. Then, bit C0 is shifted to the right by one bit.

Then, the processing for determining $|\Delta y|$ and $|\Delta x|$, using the $\Delta x$ and $\Delta y$ obtained by execution of the first and second SUB & SHIFT micro-instructions, is performed (step S3 in FIG. 5). The absolute values $|\Delta y|$ and $|\Delta x|$ are stored in the register file in the arithmetic and logic section 14. Subsequently, a third SUB & SHIFT micro-instruction is executed, instructing execution of the operation represented by $S \leftarrow |\Delta x| - |\Delta y|$ (step S4 in FIG. 5). Thus, the arithmetic and logic section 14 calculates S $(=|\Delta x| - |\Delta y|)$. The carry flag 31 in the status data 30 is supplied from the arithmetic and logic section 14 toward the shift register 17 as shown in FIG. 6(*e*). Upon the execution of third SUB & SHIFT micro-instruction, this data 30 is input to the shift register 17, as bit C2 of the direction discrimination code, as shown in FIG. 6(*f*). Bits C1 and C0 are respectively shifted to the right by one bit, as shown in FIG. 6(*f*). According to this embodiment, as shown in FIG. 6(*f*), the 3-bit direction discrimination code, i.e., C2C1C0, is set in the shift register 17, upon completion of step S4.

In this manner, according to this embodiment, the carry flag 31 representing the sign (positive (including zero) or negative) of the operation results (subtraction results) produced from the arithmetic and logic section 14 is used as a bit Ci (where i=0 to 2) of the code, i.e., C2C1C0, during execution of the subtraction operations of $y_1 - y_0 (=\Delta y)$, $x_1 - x_0 (=\Delta x)$, and $|\Delta x| - |\Delta y|$ (=S). Bit Ci is input to the shift register 17 in response to the shift enable bit SHIFT EN of logic level "1" in the corresponding SUB & SHIFT micro-instruction. As a result, the code, i.e., C2C1C0, is set in the shift register 17 upon completion of the subtraction operation $|\Delta x| - |\Delta y|$ (=S). Accordingly, in this embodiment, the direction discrimination code, i.e., C2C1C0, may be obtained without requiring the various steps which are necessary in the prior art, such as a discrimination step of the sign of the subtraction result, or a subsequent setting step of the Ci (where i=0 to 2), following the discrimination step.

Three methods of generating line coordinates, based on the direction discrimination code, i.e., C2C1C0, set in the shift register 17 in steps S1 to S4 described above, may be briefly described as follows.

First, a method of generating line coordinates by means of hardware will be described. According to this method, the direction discrimination codes C2, C1 and C0 as the set contents of the shift register 17 are transferred to the hardware DDA 22 through the bus 19 and are set in the hardware DDA 22. Other parameters such as the x and y-coordinates $(x_0,y_0)$ and $(x_1,y_1)$ of the start and end points $P_0$ and $P_1$ are set in the hardware DDA 22. When the hardware DDA is started, coordinates (line) of respective lattice points (display dots) approximating a line connecting the start and end points $P_0(x_0,y_0)$ and $P_1(x_1,y_1)$ are sequentially produced from the hardware DDA 22.

Secondly, a method for generating line coordinates by software will be described. Accordingly, eight types of nonconditional branch micro-instructions are stored in consecutive areas of the microprogram memory 12, in correspondence with the direction discrimination code, i.e., C2C1C0. These micro-instructions have branch addresses to DDA routines, which are uniquely determined by bits C2, C1 and C0 of the corresponding direction discrimination code. First, the arithmetic and logic section 14 adds the code, i.e., C2C1C0, which serves as the contents of the shift register 17 and the start addresses of the consecutive areas of the microprogram memory 12, to generate branch addresses corresponding to the code, i.e., C2C1C0. The branch addresses are supplied to the branch vector register 21 through the bus 19, being set therein. The contents (branch addresses) of the branch vector register 21 are supplied to the microprogram sequencer 11. The branch addresses from the branch vector register 21 are selected by the microprogram sequencer 11 and a selected branch address is supplied to the microprogram memory 12. The micro-instructions instructing nonconditional branching to the DDA routine corresponding to the direction discrimination codes C2, C1 and C0 are read out. The line coordinates are generated upon execution of the corresponding DDA routine.

Thirdly, another method for generating line coordinates by software will be described. According to this method, the direction discrimination code, i.e., C2C1C0, which serves as the contents of the shift register 17 are subjected to condition bit selection by the MPX 18. In the common DDA routine, using bits C2, C1, C0 of the direction discrimination code, as condition bits, decisions are made independently of the operation, and line coordinates corresponding to the obtained discrimination results are generated.

The hardware DDA 22 is not required in a graphic display apparatus of the type which generates line coordinates based on the direction discrimination code, i.e., C2C1C0, by the second or third method as described above.

Although the present invention has been described with reference to a particular embodiment, it is not limited to this. Accordingly, various changes and modifications may be made within the spirit and scope of the invention. For example, the MPX (multiplexer) 16 in the embodiment shown in FIG. 3 can be omitted, and the carry flag 31 or the sign flag 32 in the status data 30 from the arithmetic and logic section can be directly supplied to the shift register 17. However, this is possible only when the data to be processed (coordinates) is limited to only one type of data with either no sign or a sign. For example, in a graphic display apparatus which only processes data with no sign, the carry flag 31 from the arithmetic and logic section 14 can be directly supplied to the shift register 17. In a graphic display apparatus which only processes data with a sign, the sign flag 32 from the arithmetic and logic section 14 may also be directly supplied to the shift register 17.

Thus, the present invention is generally applicable to data processing systems which determine, as condition data, the combination data of bits respectively representing the sign of each result of a plurality of subtraction operations, and which determine the next processing function to be carried out.

What is claimed is:

1. A data processing system with a condition data setting function, comprising:

a microprogram memory for storing microprograms consisting of micro-instructions including a plurality of specific subtraction micro-instructions for obtaining condition data consisting of a combination of bits respectively representing the sign of the results of each of a plurality of subtraction operations;

a micro-instruction register into which a micro-instruction read out from said microprogram memory is loaded;

an arithmetic and logic section which performs an arithmetic operation, in accordance with the specific subraction micro-instruction loaded in said micro-instruction register, and which outputs status data including a carry flag and a sign flag; and a multiplexer for selecting one of said carry flag and sign flag, in response to a specific bit of the specific subtraction micro-instruction received from said micro-instruction register; and serial-to-parallel converting means for receiving the output from said multiplexer, as one of the bits of said condition data, and shifting the data already stored, thereby holding the condition data which has been obtained from the specific subtraction micro-instructions.

2. A system according to claim 1, wherein said multiplexer selects the carry flag, in accordance with the first specific bit, when the data within said arithmetic and logic section, which is specified by the specific subtraction micro-instruction, is numerical data without a sign.

3. A system according to claim 1, wherein said multiplexer selects the sign flag, in accordance with the first specific bit, when the data within said arithmetic and logic section, which is specified by the specific subtraction micro-instruction, is numerical data with a sign.

4. A system according to claim 1, wherein the specific subtraction micro-instruction includes a second specific bit for controlling the shift operation of said serial-to-parallel converting means.

5. A system according to claim 1, wherein the condition data comprises a 3-bit direction discrimination code for a line connecting a start point $P_0(x_0,y_0)$ and an end point $P_1(x_1,y_1)$.

6. A system according to claim 5, wherein the plurality of specific subtraction micro-instructions are three micro-instructions consisting of a first micro-instruction for obtaining a difference $\Delta y$ between a y-coordinate $y_1$ of the end point $P_1$ and a y-coordinate $y_0$ of the start point $P_0$, a second micro-instruction for obtaining a difference $\Delta x$ between an x-coordinate $x_1$ of the end point $P_1$ and an x-coordinate $x_0$ of the start point $P_0$, and a third micro-instruction for obtaining a difference S between an absolute value $|\Delta x|$ of difference $\Delta x$ and an absolute value $|\Delta y|$ of difference $\Delta y$.

7. A system according to claim 6, wherein the data output by said serial-to-parallel converting means when all of the first to third micro-instructions have been executed represents the direction discrimination code.

8. A system according to claim 7, wherein said serial-to-parallel converting means comprises a serial-to-parallel shift register.

* * * * *